United States Patent [19]

Singewald et al.

[11] 4,297,207

[45] Oct. 27, 1981

[54] PROCESS AND APPARATUS FOR THE ELECTROSTATIC DRESSING OF CARNALLITE-CONTAINING CRUDE POTASSIUM SALTS

[75] Inventors: Arno Singewald, Kassel; Irving Geisler; Günter Fricke, both of Heringen; Rudolf Knappe, Kassel, all of Fed. Rep. of Germany

[73] Assignee: Kali and Salz AG, Kessel, Fed. Rep. of Germany

[21] Appl. No.: 25,521

[22] Filed: Mar. 30, 1979

Related U.S. Application Data

[63] Continuation of Ser. No. 813,845, Jul. 8, 1977, abandoned, which is a continuation-in-part of Ser. No. 775,047, Mar. 7, 1977, abandoned.

[30] Foreign Application Priority Data

Mar. 5, 1976 [DE] Fed. Rep. of Germany ..... 2609048

[51] Int. Cl.[3] ..... B03B 1/00

[52] U.S. Cl. ..... 209/9; 209/127 C

[58] Field of Search ..... 209/3, 9, 127–131

[56] References Cited

U.S. PATENT DOCUMENTS

| | | | |
|---|---|---|---|
| 1,222,305 | 4/1917 | Kraus | 209/127 B |
| 2,168,681 | 8/1939 | O'Brien | 209/127 A |
| 2,559,076 | 7/1951 | Johnson | 209/127 A |
| 2,971,127 | 2/1961 | Brustad | 209/127 R X |
| 3,225,924 | 12/1965 | Autenveitn | 209/127 R X |
| 3,458,039 | 7/1969 | Singewald | 209/9 |
| 3,581,886 | 6/1971 | Singewald | 209/127 C X |

FOREIGN PATENT DOCUMENTS

| | | | |
|---|---|---|---|
| 650049 | 10/1962 | Canada | 209/9 |
| 750728 | 1/1945 | Fed. Rep. of Germany | 209/127 B |
| 842431 | 8/1952 | Fed. Rep. of Germany | 209/127 B |
| 752599 | 3/1953 | Fed. Rep. of Germany | 209/127 C |
| 751987 | 1/1954 | Fed. Rep. of Germany | 209/127 C |
| 1154052 | 9/1963 | Fed. Rep. of Germany | 209/127 R |

*Primary Examiner*—Robert Halper

*Attorney, Agent, or Firm*—Millen & White

[57] ABSTRACT

A carnallite-containing crude salt is separated into a carnallite fraction, a sylvite fraction and an abandonable residue by grinding the salt to an average particle size of about 1.5 mm., conditioning the particles in a conventional manner with from 5–300 g/t of a conventional conditioning agent adjusting the relative humidity of the conditioned particles to 5–25%, and subjecting the resulting particles to electrostatic separation in two stages, wherein in the first stage the particles are subjected to a high voltage electric field having a field length of 0.4 to 1.2 m to separate a carnallite fraction by imparting to the carnallite fraction a high sidewards velocity relative to the initial downward velocity upon entering the field, thereby causing deflection of the carnallite away from a middlings fraction, and wherein in the second stage the first stage middling fracton is subjected to a second high voltage electric field having a field length of 1.5 to 2.5 m to f or m a sylvite fraction, a second middlings fraction which also has a high sidewards velocity imparted thereto relative to the initial downward velocity upon entry into the second field thereby causing deflection of the sylvite fraction away from and an abandonable residue which has a sidewards velocity imparted thereto opposite in direction to the sidewards velocity of the sylvite for deflection therefrom and from the second middlings fraction.

25 Claims, 2 Drawing Figures

Figure 1:
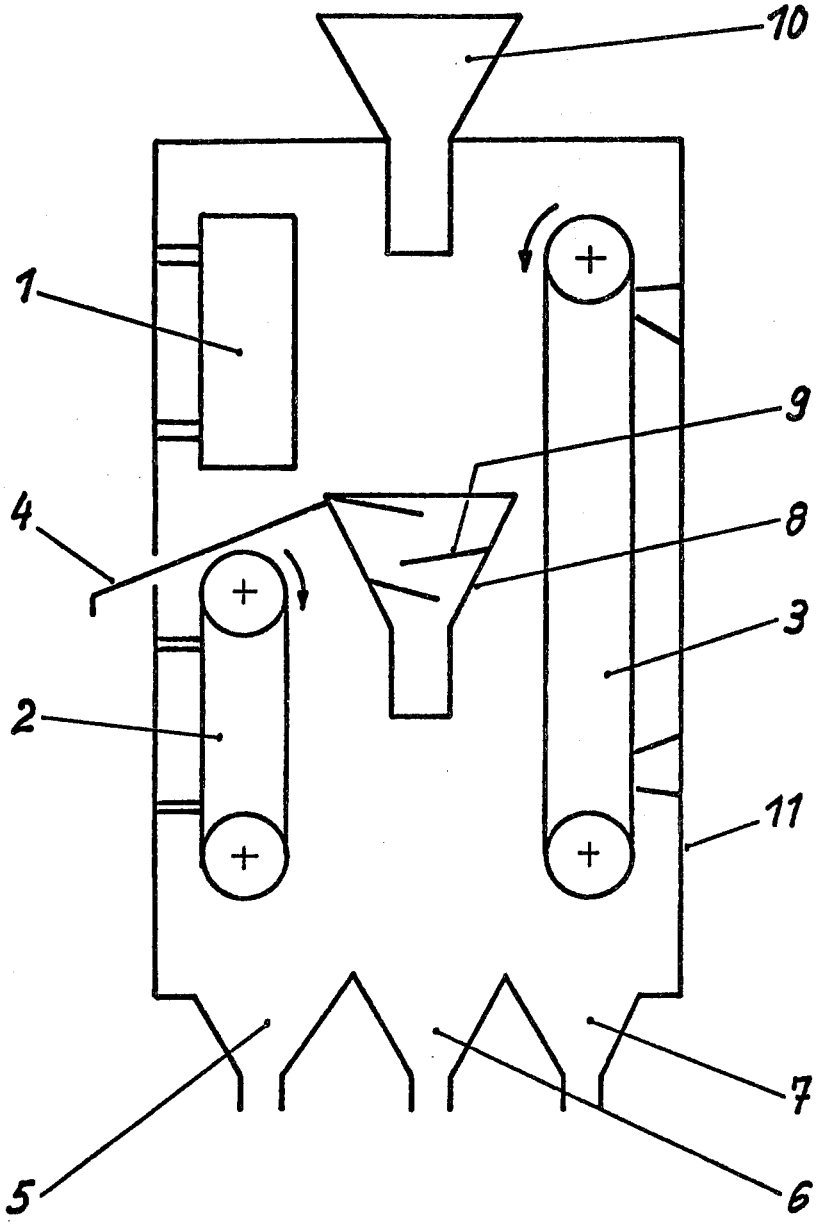

PROCESS AND APPARATUS FOR THE ELECTROSTATIC DRESSING OF CARNALLITE-CONTAINING CRUDE POTASSIUM SALTS

This is a continuation, of application Ser. No. 813,845 filed July 8, 1977, now abandoned which is in turn a continuation-in-part of Ser. No. 775,047, filed Mar. 7, 1977, and now abandoned.

BACKGROUND OF THE INVENTION

In numerous potassium deposits carnallite occurs together with sylvite or hard salt. The dressing of such carnallitic mixed salts requires special measures, which have for their goal the separation of the carnallite, either by itself or together with sylvite, from foreign minerals which do not contain potassium or which contain only small quantities of potassium.

For the separation of these mixed salts into the components thereof, electrostatic separating processes have been used. These processes depend upon the differences in conductivity of the components of the mixture and rest mainly on the finding that the film of alkali which forms on the surface of the mixed salt particles due to absorption of humidity from the ambient air develops on the carnallite crystals at higher temperatures and lower humdities than on the crystals of the other mixed components. For these processes, as described, for example, in the German Pat. Nos. 1,060,331 and 1,092,401, a previous chemical conditioning of the mixed salts is not required. However, these processes require a high expenditure in power and apparatus. For example, these processes require the use of roller separators since this type of separator will assure the necessary contact of the dressing material with an electrode. However with these separators a specific separator performance of at most only 0.5 ton of crude salt per meter of separator width an hour may be achieved.

Another development for the electrostatic separation of the components of the crude potassium salt uses the opposite electric frictional charge of the individual components to accomplish a separation in the electrostatic field. This phenomenon, as is well known, rests essentially on the fact, that in case of frictional contact of two bodies, the material which has the higher dielectric constant will be charged positively. Thus, the mixtures that are to be separated are moved in a fine dispersion across frictional surfaces made of substances having dielectric constants which lie between those of the components of the mixture that are to be separated. Mixtures treated in this manner may be separated in so-called free-fall separators as well as in roller separators. However, the separation effected by the pretreatment of the material to be separated is not satisfactory.

Therefore, the finding that the variable contact-electrical chargings of the components of the crude potassium salt is greatly improved by conditioning agents, and that certain temperatures and humidities of the atmosphere must be maintained during the electrostatic separation whenever the separation is accomplished in free-fall separators, represented an essential step forward.

Thus, for example, according to the process known from U.S. Pat. No. 3,217,876, the mixed salt that is to be separated is first treated, in a finely ground state, with an organic anionic surface conditioning agent in an amount of between about 0.01 and about 0.66 pounds of conditioning agent per ton of the mixed salt to be separated. The organic anionic conditioning agent may comprise, for example, carboxylic acids, their derivatives and their salts and mixtures, wherein the general formula of such carboxylic compounds is $R—(COOR_1)_n$, where R is a hydrocarbon radical, $R_1$ is hydrogen, a metal or hydrocarbon radical, and n is a whole number. The carnallite alone or mixed with sylvite is separated from this mixed salt by electrostatic separation at certain temperatures and certain relative atmospheric moisture.

Sulfonates or sulfates, which contain one or more $SO_3Me$ or $SO_4Me$ groups and at least 6 C-atoms in the molecule wherein Me is a metal ion, such as an alkali metal ion, have also been known as conditioning agents for these separations, for the preliminary treatment of the mixed salt. Still other conditioning agents are set forth in U.S. Pat. No. 3,217,876, such agents being incorporated herein by reference.

The sylvite-carnallite preconcentrates obtained by the above process must be separated still further for the production of technically pure products. For this, a process has been known, for example, from the U.S. Pat. No. 3,225,924, the disclosure of which is incorporated herein by reference. According to that patent, the sylvite-carnallite preconcentrate is conditioned with organic acids, such as, for example, benzoic, phthalic, salicylic, cinnamic, atropic, phenylacetic and vanillic acid, as well as with their salts or simple substitution products, or with nitrosonaphthols, or with mixtures of these substances.

These processes for the electrostatic separation of crude potassium salts based on contact-electric charging have the disadvantage that sylvite is likewise inclined increasingly toward a reversal of charge with increasing carnallite content of the crude potassium salt and is charged against carnallite. These facts are confirmed by the results of the experiments stated subsequently in example 1. These results, obtained by experiments carried out in accordance with the status of the prior art, show that it is not possible according to present knowledge to separate crude carnallitic salts with a carnallite content of over 10% by weight into a $K_2O$ valuable substance fraction consisting of sylvite and carnallite by way of electrostatic separation, and to separate such crude salt into an abandonable residue which consists essentially of native magnesium sulfate and rock salt or of rock salt alone.

Therefore, prior to the present invention, there has been a need for a process for separating carnallitic crude potassium salts by means of electrostatic separating techniques into a $K_2O$ valuable substance fraction and into an abandonable residue which consists essentially of a mixture of native magnesium sulfate and rock salt or of rock salt alone. According to the present invention, it has now been found that carnallite-containing ground, conditioned potassium salts can be separated into a $K_2O$ valuable substance fraction and into an abandonable residue which consists essentially of a mixture of native magnesium sulfate and rock salt or rock salt alone by treating the carnallitic crude salts with air of 5 to 25% relative humidity in two steps by means of electrostatic high voltage fields. According to the present process, a carnallitic fraction is separated from the crude potassium salt in a first separator section of 0.4 to 1.2 m field length (falling section) and the middlings which had become deficient or depleted in carnallite are delivered to a second separator section of 1.5 to 2.5 m field length (falling section) and are there separated into a sylvite preconcentrate, a middling and a residue deficient in valuable substances.

Advantageously the middling obtained in the second separator section is recirculated in this second separator section.

In order to carry out the process of the invention, carnallitic crude potassium salts are used which have advantageously been ground to an average particle size of 0.5 to 1.5 mm. As is well known, these carnallitic crude potassium salts contain a considerable quantity of carnallite and, in addition, rock salt and possible native magnesium sulfate.

After grinding, the crude potassium salt is conditioned in a manner known per se, for example, in the manner set forth in U.S. Pat. Nos. 3,217,876 and 3,225,924. For this, the conditioning agents which have been proposed in U.S. Pat. Nos. 3,217,876 and 3,225,924, and which have been discussed above, may be used in the quantities of generally about 0.01 to 0.66 pounds of conditioning agent per ton of mixed salt, more or less being dependent on the particular source of crude salt. Preferably, these conditioning agents are used in quantities of 5–300 g/t crude potassium salt. The conditioning agent actually is mixed as a solution or emulsion with the crude potassium salt to be dressed in such a way, that the conditioning agent is distributed in the crude potassium salt as homogenously as possible. For this purpose, water generally is suitable as the solvent or emulsifier, and an aqueous solution containing, for example, 2.5% by weight of the conditioning agent has been found to be satisfactory. However, in place of water, an alcohol such as methanol, ethanol, or isopropanol may be used as the solvent. Other solvents or emulsifiers may be selected as a matter of choice depending upon the particular conditioning agent employed. Any solvents or emulsifiers which are used during the conditioning are to be removed prior to the introduction of the conditioned crude potassium salt into the electrostatic separator. This may be accomplished, for example, by blowing a current of heated air (100°–175° F.) through the conditioned salt mixture while stirring and mixing the same. It will be appreciated that the portion of the crude potassium salt which is added in the second separator step may be so added without any additional conditioning being performed. However, if so desired, that portion of the crude salt which is added in the second separator step may be conditioned, for example, in the same manner and with the same conditioning agent as was the case for the original conditioning. However, the conditioning may be changed by the application of a conditioning agent which is different from the agent used in the first step.

After the first conditioning, the finely ground crude potassium salts are adjusted to a relative humidity between 5 and 25% in a conventional manner. For example, the salts may be adjusted in an apparatus as described, for example, in German Pat. No. 1,283,771, to ascertain relative humidity, which may be between 5 and 25% and the most favorable value of which for the pertinent separating material may easily be determined by simple preliminary experiments. Possibly the crude potassium salt, in case of this adjustment to a certain relative humidity, may be preheated to the temperature at which the electrostatic separation of the components is to take place. Advantageously this temperature is between 20° and 80° C. However, it may also be up to 200° C.

The conditioned crude potassium salt, adjusted to a certain moisture content and possible to a certain temperature, is then inserted in a high voltage field of an electrostatic separator. As can be appreciated, the downward velocity of the material at the point of entry into this field is negligible when compared to the average velocity of the material in the field. The average velocity is determined by the force of gravity acting on the material as well as the sidewards force of deflection generated by the field. In this case, the high voltage field is to be developed by proper selection of the electrodes and their size, such that the falling distance of the material fed into the separator through the high voltage field amounts to 0.4 to 1.2 m. Since the carnallite has a high specific surface charge, it is very much deflected in the high voltage field and is to be found greatly enriched immediately adjacent to the positive electrode of the separator. As can be appreciated from FIG. 2, and as will be described later, as the downward velocity of the material due to gravity increases, there is a significantly less deflection of the material. Thus, it is clear that the entry velocity of the material into the field is negligible when compared to the average velocity imparted to the material, travelling through the field, by the combined force of gravity and the force generated by the electric field. By a correspondingly arranged discharge arrangement, a fraction, greatly enriched with carnallite may thus be removed from the separator as a carnallite preconcentrate and may be fed to an additional processing, for example, to a separate after-purification. The fraction obtained as a middling, thereby becomes so deficient or depleted in carnallite, that said fraction can be fed to an additional electrostatic purification to recover sylvite.

For this purpose, this middling fraction is fed to a second separator wherein the distance through which the material will fall through an electrostatic high voltage field amounts to 1.5 to 2.5 m. In this high voltage field, the sylvite is deflected to the positive electrode and may be removed from the separator by means of a properly disposed discharge arrangement as a sylvite preconcentrate with an output for sylvite of about 70%. The middling discharging from the second separator by means of a second discharge arrangement is preferably circulated through the second separator. In addition, a residual fraction may be removed from the second separator by means of a third discharge arrangement located near the negative electrode, the content of valuable substance of which is so small that it may simply be dismissed.

Both the carnallite as well as the sylvite preconcentrate may be processed in an additional electrostatic separation in separators of traditional construction into concentrates with over 90% carnallite or sylvite content, whereby the native magnesium sulfate, contained in both concentrates, remains in the residue. However, there also is the possibility to process these preconcentrates separately or jointly to high percentage potassium fertilizer salts and magnesium sulfate.

In the process of the invention, the losses of valuable substance amount to only about 6% for $K_2O$ and only about 5 to 6% for native magnesium sulfate, and they thus are extremely small. According to the process of the invention, crude potassium salts, especially with high carnallite content, may thus be processed in one operation to preconcentrates, without the occurence of opposite charging of the sylvite, as compared to carnallite, which could always be observed in prior processes for the electrostatic separation of such salt mixtures. Also, as a residue, there remains merely a product which because of its small content of valuable substance, may be eliminated from the process.

For carrying out the invention, an apparatus is particularly suited, of which an example has been shown schematically in FIG. 1. This apparatus has band or tube electrodes made of conductive material disposed vertically in a housing with arrangements for an inlet for the material and an outlet for the products and with a stripping arrangement, which electrodes cooperate for the development of electrostatic high voltage fields. As shown in FIG. 1, electrode 3 extends over the entire length of the electrodes 1 and 2, with electrode 1 being about 0.4 to 1.2 m long and electrode 2 being disposed beneath electrode 1 and being about 1.5 to 2.5 m long. Below the electrode 1, but above the electrode 2, there is provided an arrangement 4 for the discharge of the products. A funnel-shaped member 8 made of nonconductive material has been disposed in the central portion of the apparatus, whereby the upper edge of said funnel 8 is located about at the level of the lower end of the electrode 1 and the outlet of the funnel 8 terminates about at the level of the middle of the electrode 2.

The electrode 1 may be developed as a horizontally enveloping band made of conductive material which is driven by way of one or two reversing rollers. The electrode 2 is developed advantageously as a vertically enveloping band, the drive of which likewise is accomplished by way of one or two reversing rollers. The electrode 3 is also formed by a vertically enveloping band which consists of conductive material and which is driven by way of one or two reversing rollers. But there is also the possibility of developing individual or all electrodes 1, 2 and 3 as vertically standing tubes rotating around their axes and made of conductive material. The electrodes 1 and 2 are disposed in the housing 11 of the apparatus in such a way, that they lie opposite the electrode 3. While the electrode 3 is grounded, the electrodes 1 and 2 are connected with a high voltage source and to be sure advantageously with its positive pole. The distance of the electrodes 1 and 2 from the electrode 3 is to be selected such, that between the electrodes 1 and 2 on the one hand and the electrode 3 on the other hand, electric high voltage fields may develop, whenever these electrodes are connected with a high voltage source or with ground. Advantageously, the electrodes 1, 2 and 3 are provided with stripping arrangements outside of the developing electric fields, which stripping arrangements will remove from the surfaces of the electrodes the fine dust settling there. A housing 11 in its upper part has an arrangement 10 through which the material that is to be separated is fed into the apparatus. This arrangement 10 for the inlet of the material and the housing 11 advantageously consist of nonconductive materials. The arrangement 4 for the discharge of the products may be developed, for example, as a chute of nonconductive material. In the funnel 8, inserts 9 are provided for deflecting the material. As shown, the inserts 9 may be disposed in the form of cascades. These inserts have been provided for raising the number of contactings of the mineral particles so as to thereby increase the mutual charge of the mineral particles, while slowing down the falling speed. Thereby, again reducing the velocity of the material at the point of entry into the second field to be negligible when compared to the average velocity of the material within the field. At the lower end of the housing 11, the arrangements 5, 6 and 7 have been provided for the discharge of the products.

After having been ground and conditioned in the manner described above, the crude potassium salt that is to be separated will be fed into the separator through the arrangement 10. The salt will thus pass downward between the electrodes 1 or 2 and 3 between which electrical high voltage fields have been developed. The carnallite preconcentrate is carried off from the separator by way of the discharge arrangement 4, while the residual material is fed in through the funnel 8 to the second electric high voltage field, and is there separated into a sylvite preconcentrate, a middling and a residue. The sylvite preconcentrate leaves the separator between the discharge arrangement 5 while the middling and the residue are conducted out of the separator through the discharge arrangements 6 and 7, respectively. While the residue from the discharge arrangement 7 is abandoned, the middlings taken from the discharge arrangement 6 may again be returned to the second separator step by means of the funnel 8.

The arrangement according to the invention for the electrostatic separation of crude potassium salts, as compared to traditional electrostatic separators, has the technical advantages of a most compact construction with fewer construction elements and thus a lower expenditure of material with less space requirement. With the apparatus according to the invention it is possible, according to the process of the invention, to decompose crude potassium salts rich in carnallite with a decreased expenditure of apparatus by way of electrostatic separation in one operating process into a carnallite preconcentrate and a sylvite preconcentrate, as well as an abandonable residue, and to avoid the recharging of the sylvite.

EXAMPLE 1 (Experiments with relation to the status of the prior art)

The subsequently stated results of an experimental series of runs show the recharging tendency of the sylvite in the case of traditional electrostatic separations of crude potassium salts in dependence of their carnallite content. The crude potassium salt ground to a grain size of up to 1 mm is conditioned with 100 g/t of salicylic acid and is brought to a temperature of 50° C. at a relative atmospheric moisture of 10%. At this temperature, the conditioned crude potassium salt is fed to a free-falling separator and is separated in it at a field intensity of 4 kV/cm.

The results of these experiments are set forth in Table I and illustrate that according to the status of the prior art, it is not possible to separate crude potassium salts with a carnallite content of over 10% by weight into a carnallite and a sylvite preconcentrate, as well as into an abandonable residue.

TABLE I

| Fed in material Content (%) | | | Concentrate Content (%) | | | Residue Content (%) | | | Yield (%) | | |
|---|---|---|---|---|---|---|---|---|---|---|---|
| $K_2O$ | KCl | Carn. | $K_2O$ | KCl | Carn. | $K_2O$ | KCl | Carn. | $K_2O$ | KCl | Carn. |
| 11.4 | 16.2 | 7.0 | 25.2 | 35.7 | 15.5 | 1.5 | 2.1 | 0.9 | 92.5 | 92.5 | 92.5 |
| 11.4 | 15.3 | 10.0 | 25.9 | 34.7 | 23.4 | 1.8 | 2.5 | 1.2 | 90.5 | 90.2 | 93.0 |

TABLE I-continued

| Fed in material Content (%) | | | Concentrate Content (%) | | | Residue Content (%) | | | Yield (%) | | |
|---|---|---|---|---|---|---|---|---|---|---|---|
| $K_2O$ | KCl | Carn. | $K_2O$ | KCl | Carn. | $K_2O$ | KCl | Carn. | $K_2O$ | KCl | Carn. |
| 11.4 | 14.1 | 14.8 | 25.5 | 31.0 | 35.0 | 2.2 | 3.1 | 1.65 | 88.3 | 86.5 | 93.2 |
| 11.4 | 12.6 | 20.3 | 19.8 | 18.7 | 46.9 | 5.6 | 8.4 | 2.0 | 70.7 | 60.3 | 94.1 |

EXAMPLE 2

The subsequently stated results of an experimental series or runs show the influence of the length of the falling section in the electric high voltage field on the sylvite-carnallite-ratio in the fractions, which corresponding to the illustration in FIG. 2, have been taken from the separator. A crude potassium salt (13.3% by weight of sylvite, 6.3% by weight of carnallite, 19.1% by weight of native magnesium sulfate and 61.3% by weight of rock salt), ground to 1 mm is used as starting material which after conditioning with 100 g/t of salicylic acid and 40 g/t of ammonium acetate was heated to a temperature of 50° C. at a relative atmospheric moisture of 12%.

In the case of this temperature, this crude potassium salt is fed into a free-falling separator with variable electrode length, operated with a voltage of 4 kV/cm. The sylvite-carnallite ratios appearing in the material collected near the positive electrode are shown in Table II.

TABLE II

| Falling section (cm) | Sylvite-carnallite-ratio in the fractions[1,2] 1 | 2 | 3 | 4 |
|---|---|---|---|---|
| 40 | 1:1.06 | 1:0.89 | 1:0.68 | 1:0.51 |
| 80 | 1:0.85 | 1:0.70 | 1:0.47 | 1:0.37 |
| 120 | 1:0.74 | 1:0.60 | 1:0.38 | 1:0.35 |

Figure 2:
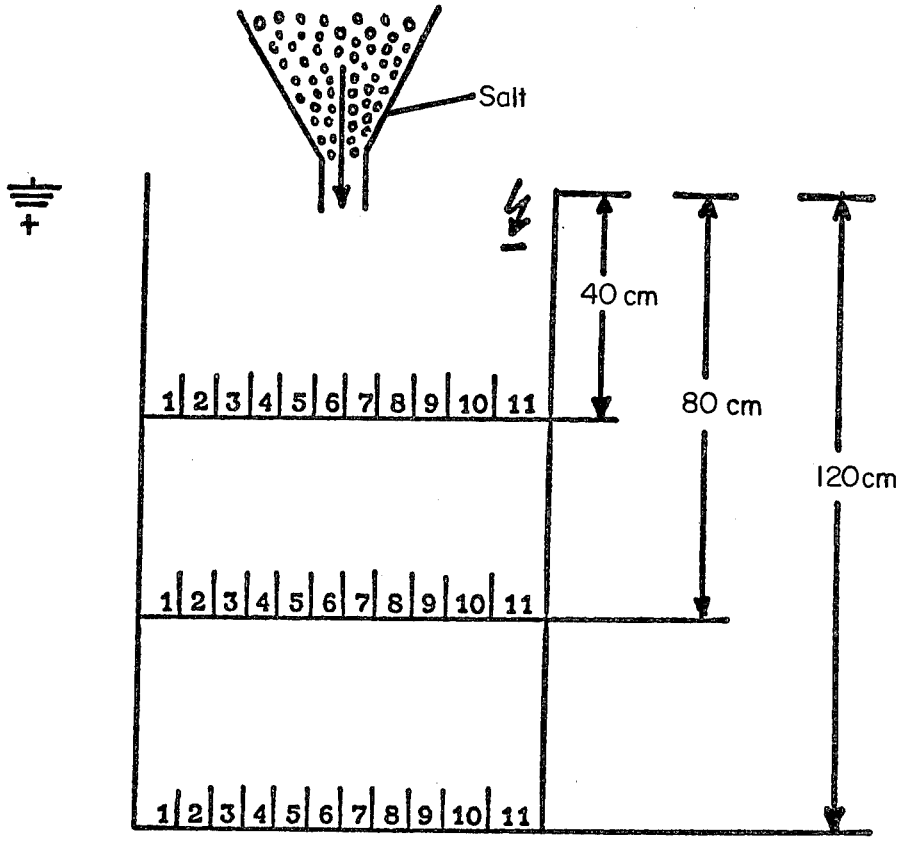

[1]Ratio sylvite: carnallite in the crude salt = 1:0.47.
[2]The fraction numbers 1,2,3 and 4 correspond to the numbered collection zones in FIG. 2.

From these results one can deduce that the sylvite-carnallite ratio in the space adjacent to the positive electrode drops with an increasing falling section. One can furthermore deduce from these results the realization that in a high voltage field of 4 kV/cm, the falling section of the crude potassium salt must not exceed 1.20 m whenever carnallite is to be separated preferably, i.e., as the velocity downward increases, then separation and the relative deflection of the material significantly decreases. Thus, after 1.20 m this deflection is negligible because the downward velocity of the material has increased to the point wherein the sidewardly directed velocity imparted by the field can be considered relatively negligible.

EXAMPLE 3

A crude potassium salt (24% by weight of sylvite, 16.9% by weight of carnallite, 37.1% by weight of native magnesium sulfate and 22% by weight of rock salt) is conditioned with 100 g/t of salicylic acid and is heated to the separating temperature of 50° C. at an atmospheric moisture of 15%. This potassium salt is then fed into an apparatus according to the invention with a first falling section in the electric high voltage field having a field length of 0.4 m and a second falling section in the electric high voltage field having a field length of 2.0 m. After the first falling section, 39.5% by weight of the quantity used are obtained as a carnallite preconcentrate, which has the composition set forth in Table III.

TABLE III

| Designation | Content (in %) | Output (in %) |
|---|---|---|
| $K_2O$ | 15.3 | 33.3 |
| sylvite | 13.9 | 22.9 |
| carnallite | 38.5 | 89.9 |
| native magnesium sulfate | 42.3 | 45.0 |
| rock salt | 5.3 | 9.6 |

The middle fraction from the first falling section which makes up 60.5% by weight of the starting quantity of the crude potassium salt is transferred to the second falling section from which a sylvite preconcentrate is obtained in a quantity of 39.4% by weight of the starting quantity. The sylvite preconcentrate has the composition shown in Table IV.

TABLE IV

| Designation | Content (in %) | Output (in %) |
|---|---|---|
| $K_2O$ | 27.7 | 60.6 |
| sylvite | 43.1 | 70.8 |
| carnallite | 2.1 | 4.8 |
| native magnesium sulfate | 46.1 | 49.6 |
| rock salt | 8.1 | 14.5 |

The residue of the second falling section comprises 21% by weight of the originally used quantity of crude potassium salt and has the composition set forth in Table V.

TABLE V

| Designation | Content (in %) | Output (in %) |
|---|---|---|
| $K_2O$ | 5.2 | 6.1 |
| sylvite | 7.1 | 6.3 |
| carnallite | 4.3 | 5.3 |
| native magnesium sulfate | 9.5 | 5.4 |
| rock salt | 79.1 | 75.9 |

In free falling separators with a falling section of 2 m in an electric field of 4 kV/cm, the preconcentrates can be processed into concentrates. Thus, for the carnallite preconcentrate, for example, a concentrate of the composition shown in Table VI is obtained:

TABLE VI

| Designation | Content (in %) | Output (in %) |
|---|---|---|
| $K_2O$ | 18.7 | 15.6 |
| sylvite | 4.8 | 2.9 |
| carnallite | 92.3 | 89.7 |
| native magnesium sulfate | 1.3 | 0.5 |
| rock salt | 1.6 | 0.9 |

The sylvite preconcentrate may be transferred in the same manner into a sylvite concentrate with the composition shown in Table VII:

TABLE VII

| Designation | Content (in %) | Output (in %) |
|---|---|---|
| $K_2O$ | 58.1 | 55.0 |
| sylvite | 91.1 | 64.6 |
| carnallite | 3.1 | 3.0 |
| native magnesium sulfate | 1.3 | 0.5 |
| rock salt | 4.5 | 3.6 |

From these two concentration steps residual fractions are obtained which altogether have the composition shown in Table VIII:

TABLE VIII

| Designation | Content (in %) | Output (in %) |
|---|---|---|
| $K_2O$ | 9.0 | 23.3 |
| sylvite | 13.4 | 26.2 |
| carnallite | 3.6 | 10.0 |
| native magnesium sulfate | 73.8 | 93.6 |
| rock salt | 9.2 | 19.6 |

The previously mentioned products may be processed according to the customary processes into technically pure salts or fertilizers.

What is claimed is:

1. In a process for the electrostatic dressing of a carnallite and sylvite-containing crude potassium salt, wherein the crude salt is ground, conditioned with an organic acid or a metal sulfate or sulfonate, and treated with air of 5 to 25% relative humidity prior to being subjected to an electric high voltage field, the improvement which comprises:

passing the crude salt downwardly by gravity through a vertical zone of first electric field having a voltage of about 4 kV/cm and a field length of 0.4 to 1.2 m to divide said crude salt into a carnallite fraction and a middlings fraction deficient in carnallite, and performing said passing the crude salt step in a manner wherein the initial entrance velocity of the crude salt into said first electric field is negligible relative to the average velocity imparted to the crude salt in said first field;

recovering said carnallitic fraction;

passing said middlings-fraction downwardly by gravity through a vertical zone of second electric field having a voltage of about 4 kV/cm and a field length of 1.5 to 2.5 m to divide said middlings fraction into a sylvite preconcentrate, a second middlings fraction, and a residue deficient in valuable substances, and performing said passing said middling-fraction step in a manner wherein the initial entrance velocity of said middlings-fraction into said second electric field is negligible relative to the average velocity imparted to the middlings-fraction in said second field; and recovering said sylvite preconcentrate.

2. The process of claim 1, wherein said second middlings fraction is recirculated through said second electric high voltage field.

3. An apparatus for dressing a carnallite-containing crude potassium salt, which comprises:

a housing;

first electrically conductive electrode means disposed vertically in said housing, said first electrode means having a length of from about 0.4 to 1.2 m.;

second electrically conductive electrode means disposed vertically in said housing, said second electrode means being disposed vertically below said first electrode means and being spaced a predetermined distance therefrom, said second electrode means having a length of from about 1.5 to 2.5 m.;

third electrically conductive electrode means disposed vertically in said housing, said third electrode means being spaced from said first and second electrode means and having a length extending over the entire length of said first and second electrode means, said third electrode means being cooperable with said first and second electrode means for developing a high voltage field between said first electrode means and said thrid electrode means and between said second electrode means and said third electrode means, the space between said first electrode means and said third electrode means defining a first falling section, and the space between said second electrode means and said third electrode means defining a second falling section;

inlet means associated with said housing for introducing the crude salt to be dressed into said first falling section;

discharge means disposed in said housing at a point below said first electrode means and above said second electrode means for discharging a carnallite preconcentrate formed by the high voltage field developed in said first falling section;

means disposed at the bottom of first falling section for receiving a carnallite depleted middlings fraction from said first falling section and for feeding said fraction to said second falling section; and means for removing the products formed in said second falling section from said housing.

4. The apparatus of claim 3, wherein said means for removing the products formed in said second falling section comprises first outlet means for removing a sylvite preconcentrate, second outlet means for removing a second middlings fraction, and third outlet means for removing a residue deficient in valuables.

5. The apparatus of claim 3, wherein said inlet means and said means for feeding said carnallite-depleted middlings fraction to said second falling section are electrically non-conductive.

6. The apparatus of claim 3, wherein said means for feeding said carnallite depleted middlings fraction to said second falling section comprises a non-conductive funnel-shaped member disposed generally centrally within said housing, said funnel-shaped member having an upper inlet opening disposed approximately at the vertical level of the bottom of said first electrode means and an outlet disposed approximately at the vertical level of the middle of said second electrode means.

7. The apparatus of claim 6, wherein said first electrode means comprises a horizontally enveloping electrically conductive band.

8. The apparatus of claim 6, wherein said second electrode means comprises a vertically enveloping electrically conductive band.

9. The apparatus of claim 7, wherein said second electrode means comprises a vertically enveloping electrically conductive band.

10. The apparatus of claim 6, wherein at least one of said first, second and third electrode means comprises a vertically standing tube, said tube be electrically conductive and rotatable about its axis.

11. The apparatus of claim 6, wherein said third electrode means comprises a vertically enveloping electrically conductive band.

12. The apparatus of claim 7, wherein said third electrode means comprises a vertically enveloping electrically conductive band.

13. The apparatus of claim 8, wherein said third electrode means comprises a vertically enveloping electrically conductive band.

14. The apparatus of claim 9, wherein said third electrode means comprises a vertically enveloping electrically conductive bnad.

15. The apparatus of claim 10, wherein said third electrode means comprises a vertically enveloping electrically conductive band.

16. The apparatus of claim 6, wherein said funnel-shaped means further comprises insert means for depleting middlings fraction as said fraction passes through said means toward said second falling section.

17. The apparatus of claim 16, wherein said first electrode means comprises a horizontally enveloping electrically conductive band.

18. The apparatus of claim 8, wherein said funnel-shaped means further comprises insert means of depleting middlings fraction as said fraction passes through said means toward said second falling section.

19. The apparatus of claim 9, wherein said funnel-shaped means further comprises insert means for depleting middlings fraction as said fraction passes through said means toward said second falling section.

20. The apparatus of claim 10, wherein said funnel-shaped means further comprises insert means for depleting middlings fraction as said fraction passes through said means toward said second falling section.

21. The apparatus of claim 11, wherein said funnel-shaped means further comprises insert means for depleting middlings fraction as said fraction passes through said means toward said second falling section.

22. The apparatus of claim 12, wherein said funnel-shaped means further comprises insert means for depleting middlings fraction as said fraction passes through said means toward said second falling section.

23. The apparatus of claim 13, wherein said funnel-shaped means further comprises insert means for depleting middlings fraction as said fraction passes through said means toward said second falling section.

24. The apparatus of claim 14, wherein said funnel-shaped means further comprises insert means for depleting middlings fraction as said fraction passes through said means toward said second falling section.

25. The apparatus of claim 15, wherein said funnel-shaped means further comprises insert means for depleting middlings fraction as said fraction passes through said means toward said second falling section.

* * * * *